United States Patent [19]

Wittren

[11] 3,986,438

[45] Oct. 19, 1976

[54] HYDRAULIC CYLINDER WITH INTEGRAL FEEDBACK CYLINDER

[75] Inventor: Richard Arthur Wittren, Cedar Falls, Iowa

[73] Assignee: Deere & Company, Moline, Ill.

[22] Filed: Sept. 8, 1975

[21] Appl. No.: 611,543

[52] U.S. Cl. ..... 92/52; 92/53; 92/108; 92/110; 92/113

[51] Int. Cl.[2] ..... F01B 7/20

[58] Field of Search ..... 92/52, 108, 113, 107, 92/110, 51, 53

[56] References Cited

UNITED STATES PATENTS

| | | | |
|---|---|---|---|
| 3,139,004 | 6/1964 | Haumann | 92/108 |
| 3,398,924 | 8/1968 | Lathrop | 92/113 |
| 3,426,649 | 2/1969 | Koppers | 92/52 |
| 3,596,561 | 8/1971 | Keller | 92/108 |
| 3,610,100 | 10/1971 | Hoffman | 92/108 |
| 3,877,349 | 4/1975 | Schindel | 92/108 |

*Primary Examiner*—Martin P. Schwadron
*Assistant Examiner*—Abraham Hershkevitz

[57] ABSTRACT

A double-acting hydraulic cylinder includes a hollow cylinder body with a closed end and an end with a first rod opening. A first hollow piston and rod assembly, having a second rod opening at the piston end, projects through the first rod opening and slides in the cylinder body. A second hollow piston and rod assembly, secured at the rod end to the hollow cylinder body, projects through the second rod opening and slides in the first hollow piston and rod assembly. The first and second hollow piston and rod assemblies cooperate to form a first variable volume chamber. A rod secured to the rod end of the first hollow piston and rod assembly slidably projects into the second hollow piston and rod assembly and cooperates therewith to form a second variable volume chamber. The first variable volume chamber is connected to a first port in the cylinder body and is expandable and contractable in response respectively to retraction and extension of the first hollow piston and rod assembly. The second variable volume chamber is connected to a second port in the cylinder body and is expandable and contractable in response respectively to extension and retraction of the first hollow piston and rod assembly. The first and second variable volume chambers are sized so that the increase in the volume of one chamber is equal to the decrease in the volume of the other chamber.

11 Claims, 2 Drawing Figures

HYDRAULIC CYLINDER WITH INTEGRAL FEEDBACK CYLINDER

BACKGROUND OF THE INVENTION

The present invention relates generally to double acting hydraulic cylinders operating in conjunction with double-acting feedback cylinders and more particularly to cylinders having integral feedback cylinders.

In the past, hydraulic feedback of the cylinder rod position was accomplished by connecting a separate feedback cylinder in parallel with the hydraulic work cylinder, and where equal volume feedback was required, a double rod cylinder was used. Typical of these feedback systems which incorporated double rod cylinders is the U.S. Pat. No. 2,236,467 granted to E. C. S. Clench on Mar. 11, 1939.

These systems have the disadvantages of requiring additional space above that necessary for the work cylinder alone, additional parts for mounting the feedback cylinder, and additional design effort to establish feedback cylinder positioning and operational geometry.

SUMMARY OF THE INVENTION

The present invention provides a single cylinder assembly for performing both the work and feedback function in a hydraulic circuit.

The above and additional advantages of the present invention will become apparent to those skilled in the art from a consideration of the following detailed description of the preferred embodiment when taken in conjunction with the accompanying drawings.

DESCRIPTION OF THE PREFERRED EMBODIMENT

Figure 1:
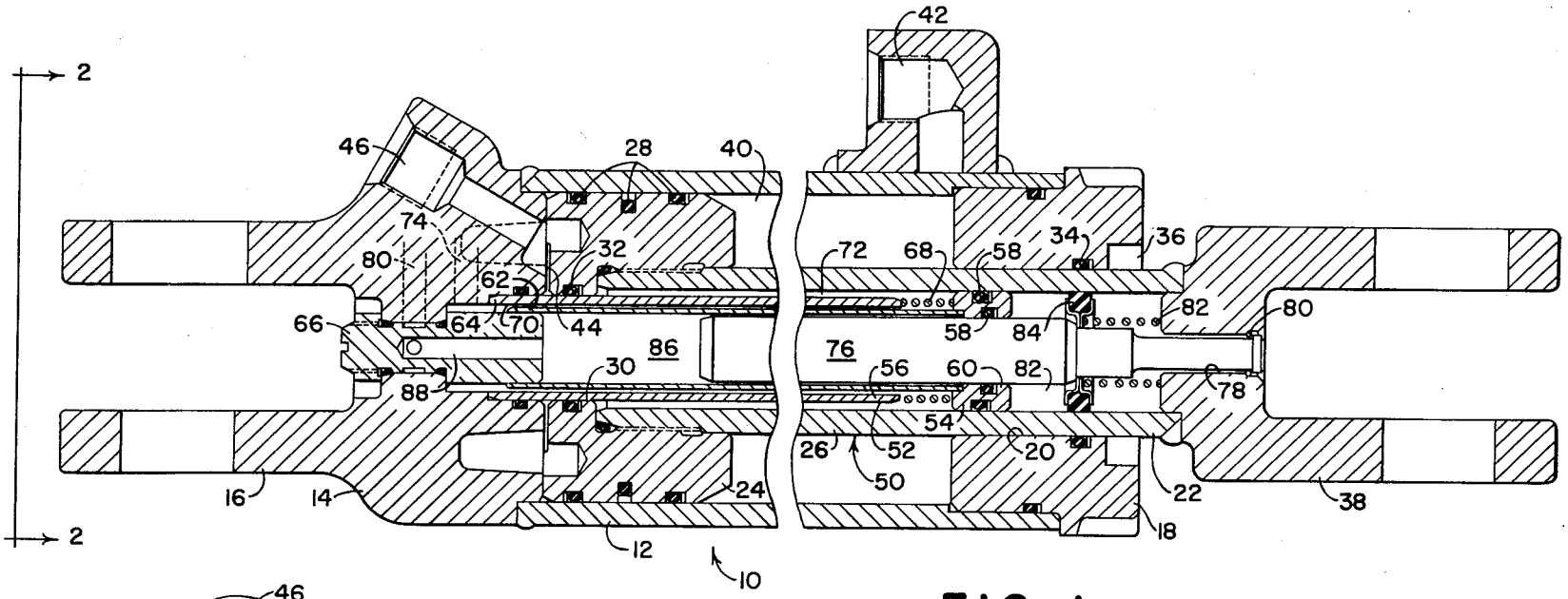
FIG. 1 is a longitudinal sectional view of the hydraulic cylinder of the present invention.

Referring now to FIG. 1, therein is shown a hydraulic cylinder with integral feedback cylinder generally designated by the numeral 10. The hydraulic cylinder 10 includes a hollow cylinder body 12 having a piston end cap 14 with a clevis portion 16 and a rod end cap 18 with a first rod opening 20 therein.

A first hollow piston and rod assembly 22 is received within the hydraulic cylinder 10 and includes a first piston 24 slidably positioned within the hollow cylinder body 12 and a first rod 26 slidably projecting through the first rod opening 20. The first piston 24 includes piston seals 28 and has a second rod opening 30 provided therein with a rod seal 32. The first rod 26 projects through the rod end cap 18 through a rod seal 34 and a rod wiper 36 and has a rod clevis 38 on the end opposite the first piston 24.

The first hollow piston and rod assembly 22 cooperates with the hollow cylinder body 12 and the rod end cap 18 to form a retraction chamber 40 which is fluidly connected to a retraction port 42 in the hollow cylinder body 12. The first piston 24 cooperates with the hollow cylinder body 12 and the piston end cap 14 to form an extension chamber 44 which is fluidly connected to an extension port 46 in the piston end cap 14.

An integral feed back cylinder generally designated by the numeral 50 includes a second hollow piston and rod assembly 52 slidably positioned within the first hollow piston and rod assembly 22. The second hollow piston and rod assembly 52 includes a second piston 54 and a second rod 56. The second piston 54 includes piston seals 58 and has a third rod opening 60 provided therein. The second rod 56 to which the second piston 54 is secured is an assembly which includes two concentric cylinder portions, inner and outer cylinder portions 62 and 64. The inner cylinder portion 62 is secured at one end to the piston end cap 14 by port-retainer assembly 66 and is fastened to the second piston 54 at the other end. The outer cylinder portion 64 upon which the first piston 24 slidingly and sealingly moves is spaced from the second piston 54 by a spring 68 and is mounted in the piston end cap 14 at the other end. The outer cross-section of the inner cylinder portion 62 and the inner cross-section of the outer cylinder portion 64 are sized to provide a space between the cylinder portions which forms a fluid passage 70.

Figure 2:
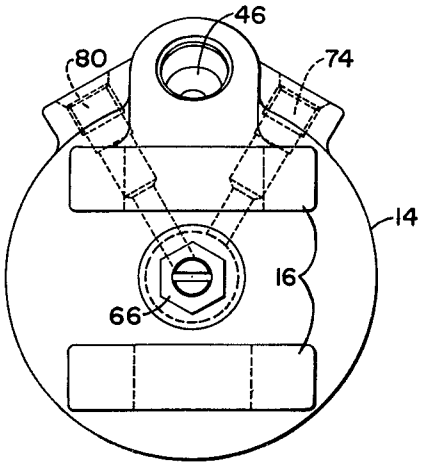
FIG. 2 is an end view of the hydraulic cylinder taken along the line 2—2.

The first and second hollow piston and rod assemblies 22 and 52 cooperate to form a first variable volume chamber 72 which is connected by the fluid passage 70 to a first port 74. A better view of the first port 74 may be had by reference to FIG. 2.

A third rod 76 slidably projects into the second hollow piston and rod assembly 52 through the third rod opening 60. The third rod 76 projects through a hole 78 in the rod clevis 38 and is prevented from withdrawing therefrom by a snap ring 80. A spring 82 presses against a breather assembly 84 which abuts the third rod 76 to prevent movement of the third rod 76 further into the hole 78.

The third rod 76 cooperates with the second hollow piston and rod assembly 52 to form a second variable volume chamber 86. The second variable volume chamber 86 is connected by a second fluid passage 88 in the port-retainer assembly 66 to a second port 80. A better view of the second port 80 may be had by reference to FIG. 2.

The third rod 76 cooperates with the first and second hollow piston and rod assemblies 22 and 52 to form a third variable volume chamber 82 which is open to the outside through the breather assembly 84 and the hole 78 to prevent fluid lock.

The integral feedback cylinder 50 is made an equal volume cylinder having equal volume displacements during retraction and extension by sizing the area of the third rod opening 60 to be equal to the difference between the area of the inner cross-section of the first rod 26 and the cross-section of the second rod 56.

In operation, as pressurized working fluid is forced through the retraction port 42 into the retraction chamber 40, the hydraulic cylinder 10 retracts to the position shown in FIG. 1. As the first hollow piston and rod assembly 22 retracts towards the piston end cap 14, the volume of the first variable volume chamber 72 will increase because the second hollow piston and rod assembly 52 is stationary with respect to the piston end cap 14 while the first hollow piston and end assembly 22 moves. Simultaneously, the volume of the second variable volume chamber 86 will decrease because the third rod 76 moves with the first hollow piston and rod assembly 22 towards the piston end cap 14. The rates of increase and decrease of the first and second variable volume chambers 72 and 86, respectively, will be exactly the same due to the sizing as previously mentioned and thus the input of fluid into the first port 74 will exactly equal the exhaust of fluid through the second port 80.

As pressurized working fluid is forced into the extension port 46 and exhausted from the retraction port 42, the first hollow piston and rod assembly 22 will extend. As the first hollow piston and rod assembly 22 extends, the volume in the second variable volume chamber 86 will increase and the volume in the first variable volume chamber 72 will decrease at exactly the same rate.

Thus, a double-acting hydraulic cylinder with an integral equal volume feedback cylinder has been presented. While the invention has been described in conjunction with a specific embodiment, it is to be understood that many alternatives, modifications, and variations will be apparent to those skilled in the art in light of the aforegoing description. Accordingly, it is intended to embrace all such alternatives, modifications, and variations which fall within the spirit and scope of the appended claims.

I claim:

1. A hydraulic cylinder comprising: a hollow cylinder body having a closed end and being provided with a rod opening at the other end; a first hollow piston and rod assembly including a piston portion slidable in the cylinder body and a rod portion slidably extending through the rod opening in the cylinder body; the first hollow piston and rod assembly being provided at one end with a rod opening, said one end being nearest the closed end of the cylinder body; a second hollow piston and rod assembly attached to the closed end of the cylinder body; the second hollow piston and rod assembly including a piston portion slidable in the first hollow piston and rod assembly and a rod portion extending through the rod opening of the first hollow piston and rod assembly so that the first and second hollow piston and rod assemblies cooperate to form a first variable volume chamber therebetween; first passage means extending through the rod portion of the second hollow piston and rod assembly and open to the first chamber; first port means in the cylinder body in communication with the first passage means for allowing said first piston to slide in one direction relative to the cylinder body; the second hollow piston and rod assembly being open to the closed end of the first hollow piston and rod assembly and closed at the end projecting through the rod opening of the first hollow piston and rod assembly; rod means carried by the closed end of the first hollow rod and piston assembly and projecting into the second hollow piston and rod assembly to form in cooperation therewith a second variable volume chamber separate from the first variable volume chamber; means for preventing communication between said first and second variable volume chambers; second passage means extending through the cylinder body and in communication with the second chamber; and second port means in the cylinder body in communication with the second passage means for allowing said frist piston to slide in another direction relative to the cylinder body.

2. A hydraulic cylinder as set forth in claim 1 wherein the first and second variable volume chambers have equal effective cross-sectional areas whereby upon extension and retraction of the hydraulic cylinder the volume of one chamber will increase and decrease at a rate equal to the rate of decrease and increase, respectively, in the volume of the other chamber.

3. A hydraulic cylinder comprising: a hollow cylinder body having a first closed end and a second end provided with a rod receiving opening; a first hollow piston and rod assembly with the piston thereof slidably mounted in the cylinder body and the rod thereof slidably projecting through the rod receiving opening in the cylinder body; the first hollow piston and rod assembly being provided at one end with a rod receiving opening of a diameter less than the internal diameter of the first hollow piston and rod assembly; a second hollow piston and rod assembly attached to the closed end of the cylinder body; the second hollow piston and rod assembly with the piston thereof slidably mounted in the first hollow piston and rod assembly and the rod thereof slidably projecting through the rod receiving opening of the first hollow piston and rod assembly so that the first and second hollow piston and rod assemblies cooperate to form a first variable volume chamber therebetween; first passage means provided in the rod of the second hollow piston and rod assembly and open to the first chamber; first port means in the cylinder body in communication with the first passage means for allowing said first piston to slide in one direction relative to the cylinder body; the second hollow piston and rod assembly being open to the closed end of the first hollow piston and rod assembly and closed at the end projecting through the rod receiving opening of the first hollow piston and rod assembly; rod means carried by the closed end of the first hollow piston and rod assembly and projecting into the second piston and rod assembly to form in cooperation therewith a second variable volume chamber having a work area equal to the effective work area of the first chamber and separate from the first chamber; means for preventing communication between said frist and second variable volume chambers; second passage means provided in the cylinder body and in communication with the second chamber; and second port means in the cylinder body in communication with the second passage means for allowing said first piston to slide in another direction relative to the cylinder body, whereby upon extension and retraction of the hydraulic cylinder the volume of one chamber will increase and decrease at a rate equal to the rate of decrease and increase, respectively, in the volume of the other chamber.

4. A hydraulic cylinder as set forth in claim 3 wherein the first and second hollow piston and rod assemblies cooperate to form a third variable volume chamber and including relief means in the first hollow piston and rod assembly in communication with the third chamber.

5. A hydraulic cylinder comprising: a hollow cylinder body having a first closed end and a second end provided with a rod receiving opening; a first hollow piston and rod assembly with the piston thereof slidably mounted in the cylinder body and the rod thereof slidably projecting through the rod receiving opening in the cylinder body; the first hollow piston and rod assembly being provided at one end with a rod receiving opening of a diameter less than the internal diameter of the first hollow piston and rod assembly; a second hollow piston and rod assembly attached to the closed end of the cylinder body; the second hollow piston and rod assembly with the piston thereof slidably mounted in the first hollow piston and rod assembly and the rod thereof slidably projecting through the rod receiving opening of the first hollow piston and rod assembly so that the first and second hollow piston and rod assemblies cooperate to form a first variable volume chamber therebetween; first passage means provided in the rod of the second hollow piston and rod assembly open to the first chamber; first port means in the cylinder body in communication with the first passage means for allowing said first piston to slide in one direction relative to the cylinder body; the second hollow piston and rod assembly having an internal opening provided therein with a cross-sectional area which is equal to the difference between the cross-sectional areas of the internal opening and the rod receiving opening in the first hollow piston and rod assembly; the second hollow piston and rod assembly being open to the closed end of the first hollow piston and rod assembly and closed at the end projecting through the rod receiving opening of the first hollow piston and rod assembly; rod means carried by the closed end of the first hollow piston and rod assembly and projecting into the second hollow piston and rod assembly to form a second variable volume chamber separate from the first variable chamber and having the cross-sectional area of the internal opening of the second hollow piston and rod assembly; means for preventing communication between said first and second variable volume chambers; second passage means provided in the cylinder body and in communication with the second chamber; and second port means in the cylinder body in communication with the second passage means for allowing said first piston to slide in another direction relative to the cylinder body whereby upon extension and retraction of the hydraulic cylinder the volume of one chamber will increase and decrease at a rate equal to the rate of decrease and increase, respectively, in the volume of the other chamber.

6. A hydraulic cylinder as set forth in claim 5 wherein the first and second hollow piston and rod assemblies cooperate to form a third variable volume chamber and including relief means in the first hollow piston and rod assembly in communication with the third chamber.

7. A hydraulic cylinder as set forth in claim 5 wherein the rod of the second hollow piston and rod assembly includes concentric, spaced apart, outer and inner cylinder portions secured to the first end of the cylinder body.

8. A hydraulic cylinder comprising: a hollow cylinder body having a first closed end and being provided with a rod opening at the second end; a first hollow piston and rod assembly including a piston portion slidable in the cylinder body and a rod portion slidably projecting through the rod receiving opening so that the first hollow piston and rod assembly and the hollow cylinder body cooperate to form a variable volume retraction chamer and the piston portion and the hollow cylinder body cooperate to form a variable volume extension chamber; retraction port means in the cylinder body in communication with the retraction chamber; extension port means in the cylinder body in communication with the extension chamber; the first hollow piston and rod assembly being provided at one end with a rod opening, said one end being nearest the closed end of the cylinder body; a second hollow piston and rod assembly attached to the closed end of the cylinder body; the second hollow piston and rod assembly including a piston portion slidable in the first hollow piston and rod assembly and a rod portion extending through the rod opening of the first hollow piston and rod assembly so that the first and second hollow piston and rod assemblies cooperate to form a first variable volume chamber therebetween; first passage means extending through the rod portion of the second hollow piston and rod assembly and open to the first chamber; first port means in the cylinder body in communication with the first passage means for allowing said first piston to slide in one direction relative to the cylinder body; the second hollow piston and rod assembly being open to the closed end of the first hollow piston and rod assembly and closed at the end projecting through the rod opening of the first hollow piston and rod assembly; rod means carried by the closed end of the first hollow rod and piston assembly and projecting into the second hollow piston and rod assembly to form in cooperation therewith a second variable volume chamber separate from the first variable volume chamber; means for preventing communication between said first and second variable volume chambers; second passage means extending through the cylinder body and in communication with the second chamber; and second port means in the cylinder body in communication with the second passage means for allowing said first piston to slide in another direction relative to the cylinder body.

9. A hydraulic cylinder as set forth in claim 8 wherein the first and second variable volume chambers have equal effective cross-sectional areas whereby upon extension and retraction of the hydraulic cylinder the volume of one chamber will increase and decrease at a rate equal to the rate of decrease and increase, respectively, in the volume of the other chamber.

10. A hydraulic cylinder as set forth in claim 8 wherein the first and second hollow piston and rod assemblies cooperate to form a third variable volume chamber and including relief means in the first hollow piston and rod assembly in communication with the third chamber.

11. A hydraulic cylinder as set forth in claim 8 wherein the rod of the second hollow piston and rod assembly includes concentric, spaced apart, outer and inner cylinder portions secured to the first end of the cylinder body.

* * * * *